United States Patent [19]

Heard

[11] 4,211,381

[45] Jul. 8, 1980

[54] MOUNTING DEVICE

[76] Inventor: Robert A. H. Heard, Church Farm, 63 Church La., Backwell, Bristol BS19 3JJ, England

[21] Appl. No.: 909,960

[22] Filed: May 26, 1978

[30] Foreign Application Priority Data

May 31, 1977 [GB] United Kingdom ..... 23038/77

[51] Int. Cl.[2] ..... A47B 96/06

[52] U.S. Cl. ..... 248/231; 403/279; 403/282

[58] Field of Search ..... 248/218.4, 230, 231; 403/279, 282; 85/1 H

[56] References Cited

U.S. PATENT DOCUMENTS

| | | | |
|---|---|---|---|
| 1,297,021 | 3/1919 | Shodron | 248/231 |
| 2,676,680 | 4/1954 | Kindorf | 85/1 H |
| 3,185,419 | 5/1965 | Kindorf | 248/230 X |
| 3,894,707 | 7/1975 | Heard | 248/231 |
| 4,013,253 | 3/1977 | Perrault | 248/243 |
| 4,066,233 | 1/1978 | Heard | 248/231 |
| 4,094,487 | 6/1978 | Heard | 248/231 |

FOREIGN PATENT DOCUMENTS

| | | | |
|---|---|---|---|
| 559211 | 8/1956 | Canada | 248/230 |
| 1511145 | 8/1975 | United Kingdom | 248/231 |

*Primary Examiner*—William H. Schultz

*Attorney, Agent, or Firm*—Larson, Taylor and Hinds

[57] ABSTRACT

A fixing device for mounting a sign to a post, the rear of the sign having a channel member with inturned lips. A strap around the post is connected to the channel by a pair of attachment members. Each member has a neck which extends through the channel mouth and an enlarged head which is retained within the channel by the lips. The neck part widens towards the head part to provide shoulders which bite into the channel lips when the strap is tightened, and thereby lock the device against movement along the channel.

8 Claims, 7 Drawing Figures

MOUNTING DEVICE

FIELD OF THE INVENTION

This invention relates to fixing devices, and is particularly applicable to devices for fixing an article such as a post to a channel-shaped member, the mouth of the channel being restricted by inturned lips. The channel may for example be provided on a sign which is being mounted to the post.

BACKGROUND AND PRIOR ART

I have previously proposed a fixing device made of stainless steel sheet for mounting a sign to a post, the rear of the sign having a channel member with inturned lips, the device comprising a plate to be inserted lengthwise in the channel and a pair of attachment members projecting from opposite ends of the plate through the channel mouth, a strap connected to the attachment members being passed around the post and tightened. This draws the plate against the inside surfaces of the channel lips; the plate providing a substantial bearing area and greatly resisting forcible removal through the channel mouth. It has been found, however, that if the strap is not sufficiently tightened the device can be slid lengthwise out of the channel, and thus the sign can be accidentally or deliberately detached from its mounting.

SUMMARY OF THE INVENTION

According to the present invention there is provided an attachment member for use in fixing an article to a channel-shaped member, the mouth of the channel being restricted by inturned lips, the attachment member comprising a head part to be located within the channel and be retained by the lips thereof, a narrower neck part connected to the head part for extending through the restricted mouth of the channel, and a body part connected to the neck part and attached or adapted for attachment to a strap to be fastened around said article to hold it to the channel-shaped member, the neck part of the attachment member widening in the region of the head part to provide shoulders arranged to bear edgewise upon the inside surfaces of the channel lips when the strap is tightened around the post and locally deform the lips so as to key the attachment member against movement along the channel.

The attachment member is preferably made from sheet metal, the shoulders presenting an edge of the sheet to the channel lips. Preferably the attachment member has two neck parts at opposite end portions of the head part and connected to respective body parts, at least one of the neck parts being provided with said shoulders. Preferably the shoulders slope between the neck part and the head part.

BRIEF DESCRIPTION OF THE DRAWINGS AND DESCRIPTION OF ILLUSTRATIVE EMBODIMENTS

Figure 1:
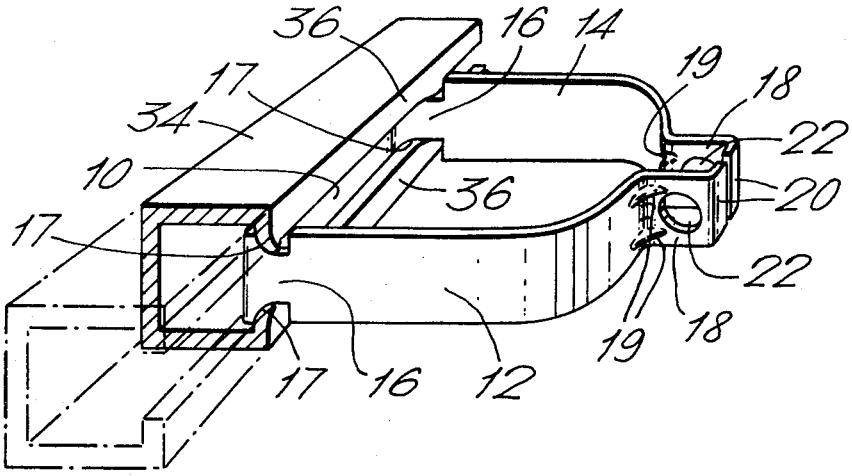
Figure 2:
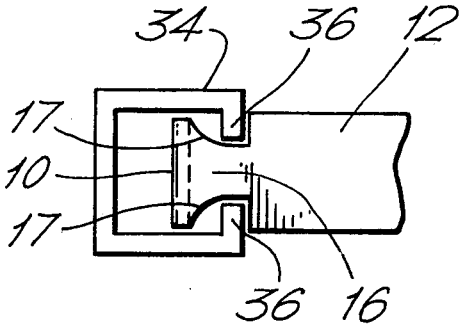
Figure 3:
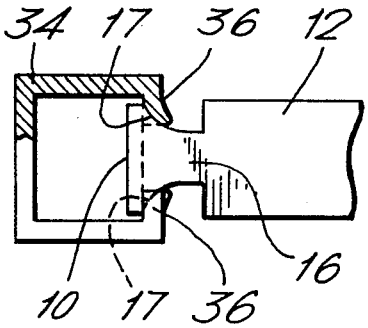
Figure 4:
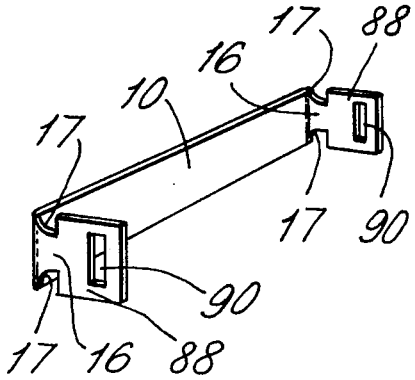
Figure 5:
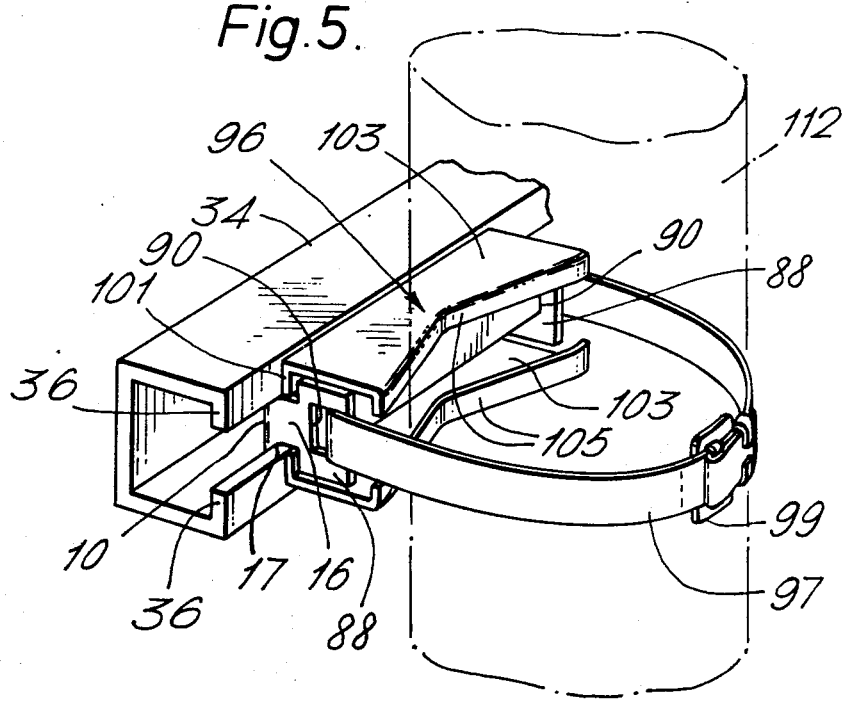
Figure 6:
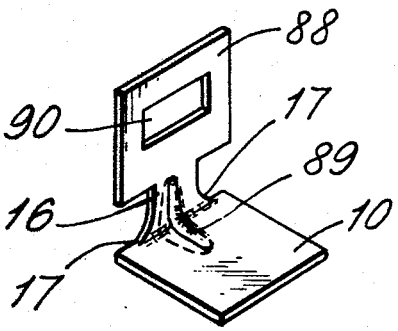
Figure 7:
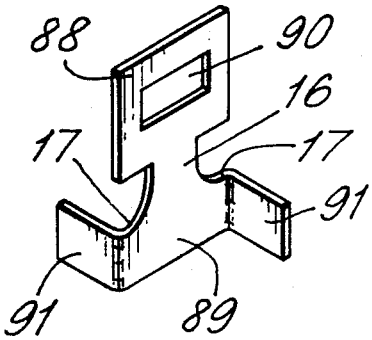

The invention will be illustrated by the following description of specific embodiments, with reference to the accompanying drawings, wherein:

FIG. 1 shows a perspective view of a first embodiment of fixing device when assembled, FIG. 2 shows an end view of part of the device of FIG. 1 during assembly, FIG. 3 shows an end view, partially cut-away, of part of the embodiment of FIGS. 1 and 2 in use, FIG. 4 shows a perspective view of a second embodiment of fixing device, FIG. 5 shows a perspective view of a third embodiment of fixing device, and FIGS. 6 and 7 show perspective views of fourth and fifth embodiments of fixing device.

Referring to the drawings, and firstly to FIGS. 1 and 2, the main part of the fixing device is stamped from stainless steel strip, and comprises an elongate plate 10 and a pair of strap parts 12,14 extending from the ends of the plate 10 initially at right angles thereto, the remote portions of the strap parts being of arcuate form so as to provide a semi-circular shape to conform to a circular post. The free ends of the strap parts are turned outwardly to provide a pair of mutually facing flanges 18, and the free ends of the flanges are mutually inturned to provide a pair of ribs 20 which limit the extent to which the flanges can be brought towards each other. The flanges are apertured at 22 to take a nut and bolt (not shown) which secures the flanges together and tightens the straps around a post. In forming the flanges 18, the sheet material is locally deformed in the angle between each strap part and its flange to provide webs 19 which extend across the angle and thereby strengthen the flanges against being bent back towards the plane of their strap parts by the pressure of the nut and bolt. The strap parts 12,14 are joined to the plate 10 through narrower necks 16. The width of each neck 16 adjacent the strap part 12 is little less than the width of the channel mouth, but at its other end it is widened the same width as the plate 10 to provide shoulders 17.

In use, the device is inserted into a channel-shaped member 34 whose mouth is restricted by inturned lips 36. This channel member, which is suitably of extruded aluminium, may be attached to part of a sign which is to be mounted to a post. The narrow part of the neck 16 enables the fixing device to be inserted into the channel by sliding it lengthwise from one end, the narrowest part of the necks 16 passing between the lips of the channel, as shown in FIG. 2. The width of the plate 10 is less than the distance between the opposite walls of the channel member 34, but greater than the width of the channel mouth. When the strap parts are tightened around the post, the plate is drawn towards the lips 36 of the channel, and the shoulders 17 bite into the lips 36. Since the channel will usually be of relatively soft aluminium while the fixing device will generally be of relatively hard stainless steel sheet, the shoulders 17 will bite into and distort the lips locally, as shown in FIG. 3. This has the effect of locking the fixing device against movement lengthwise of the channel.

A second embodiment of fixing device, which takes advantage of this effect, is shown in FIG. 4. In this embodiment, the plate 10 is joined at each end through shoulders 17 and necks 16 to rectangular body parts 88 having transverse slots 90. These slots receive a strap or straps which are tightened around a post. The plate 10 can be slid lengthwise into a channel member as described above in relation to FIG. 2. When the straps are tightened around the post, the shoulders 17 at both ends of the plate bite into the lips of the channel and securely lock the device against movement lengthwise of the channel.

A further use of the device of FIG. 4 is shown in FIG. 5. It comprises a saddle 96 made from a single piece of sheet steel, and comprises a flat base member 101 and a pair of side members 103 projecting therefrom. The side members are of similar shape, their edges remote from the base member 101 being of shallow V-shape and are turned over to provide mutually inwardly directed flanges 105. A fixing device component as shown in FIG. 4 is fitted to the saddle so that the body parts 88 are located between the side members 103 of the saddle, and the plate 10 lies on the other side of the base member 101, the ends of the base member 101 being cut away slightly to loosely receive the neck parts 16. A flexible stainless steel strap 97 is threaded through the slots 90 in the body parts 88, the ends of the strap being passed and tightened around a post 112, and secured together by suitable means, for example a "Band-It" or "Tespa" buckle 99. Prior to passing the strap around the post, however, the fixing device is slid lengthwise into the channel member 34, whose length is somewhat greater than the plate 10, the plate 10 passing into the channel in the manner described with relation to FIG. 2, while the saddle 96 lies outside the channel, the base member 101 bearing on the outside surfaces of the lips 36. The post 112 is received in the V-shaped part of the saddle, and bears upon the flanges 105. When the strap 97 is tightened around the post, the plate 10 is drawn towards the post, and the lips 36 of the channel member are thereby gripped firmly between the plate and the saddle. Provision of the shoulders 17, which bite into the lips 36 during this operation, ensures that the fixing device is locked against movement lengthwise of the channel member.

A variation of the attachment member of FIG. 4 is shown in FIG. 6, where the plate 10 is shortened, and connected to only one neck 16 and body part 88. This attachment member is used with another attachment member, which can be of the same kind or of a different kind. The strap connects both attachment members around the post. This alternative has the advantage that the distance between the attachment members can be adjusted to suit the size of post. An outward swage 89 is preferably provided in the angle between the neck 16 and plate 10 to help maintain the right-angle.

FIG. 7 shows a variation of an attachment member disclosed in my U.S. Pat. No. 3,894,707. The attachment member has a body 88 and neck 16 as in FIG. 6, but the neck extends to a coplanar head 89 which has a pair of ears 91 extending in opposite directions at 90° to the plane of the head. This attachment member can be twisted into the mouth of a channel member as more particularly described in the above-identified U.S. Pat. No. 3,894,707. In the present modification, however, shoulders 17 are provided between the neck 16 and head 89 to lock the attachment member in position.

The embodiments of FIGS. 6 and 7, and similar embodiments using two separate attachment members, although included within the scope of this invention, generally benefit less from the provision of shoulders 17 since the tension on the separate attachment members tends to pull them into a position in which they bind with the channel and resist lengthwise movement, whereas the embodiments in which a single head connects two necks 16 is more rigid and therefore more liable to slip along the channel even under the tension of the strap.

Although shoulders 17 have been shown as provided on both necks, only one neck need have them in order to provide the locking effect.

I claim:

1. An attachment member for use in fixing an article to a channel-shaped member, the mouth of the channel being restricted by inturned lips, the attachment member comprising a head part to be located within the channel and be retained by the lips thereof, a narrower neck part connected to the head part for extending through the restricted mouth of the channel, and a body part connected to the neck part and attached or adapted for attachment to a strap to be fastened around said article to hold it to the channel-shaped member, the neck part of the attachment member widening in the region of the head part, but with at least the initial widening being spaced from the head part, to provide shoulders between the neck part and the head part to bear edgewise upon the inside surfaces of the channel lips when the strap is tightened around the post and locally deform the lips so as to key the attachment member against movement along the channel.

2. An attachment member according to claim 1 made from sheet metal, the shoulders being arranged so as to present an edge of the sheet to the channel lips.

3. An attachment member according to claim 1 having two neck parts at opposite end portions of the head part and connected to respective body parts, at least one of the neck parts being provided with said shoulders.

4. An attachment member according to claim 2 having two neck parts at opposite end portions of the head part and connected to respective body parts, at least one of the neck parts being provided with said shoulders.

5. An attachment member according to claim 4 wherein the body parts are formed as straps which converge at their ends remote from the head part and terminate in out-turned flanges which are adapted to be adjustably connected together for tightening around the post.

6. An attachment member according to claim 5 wherein the flanges terminate in mutually inturned ribs.

7. An attachment member according to claim 5 wherein strengthening webs are formed in the angle between the straps and their respective flanges.

8. An attachment member according to any one of claims 1 to 7 wherein the shoulders slope between the neck part and the head part.

* * * * *